US006729741B1

(12) United States Patent
Murray

(10) Patent No.: US 6,729,741 B1
(45) Date of Patent: May 4, 2004

(54) LIGHT FITTINGS

(76) Inventor: Trevor James Murray, 332 Coatesville-Riverhead Highway R.D. 3, Albany, North Harbour (NZ)

( * ) Notice: Subject to any disclaimer, the term of this patent is extended or adjusted under 35 U.S.C. 154(b) by 0 days.

(21) Appl. No.: 09/959,930

(22) PCT Filed: May 12, 2000

(86) PCT No.: PCT/NZ00/00072

§ 371 (c)(1),
(2), (4) Date: Nov. 13, 2001

(87) PCT Pub. No.: WO00/70264

PCT Pub. Date: Nov. 23, 2000

(30) Foreign Application Priority Data

May 13, 1999 (NZ) ..... 335730

(51) Int. Cl.[7] ..... F21S 8/00; F21V 13/04

(52) U.S. Cl. ..... 362/147; 362/297; 362/308; 362/329

(58) Field of Search ..... 362/145–152, 362/267, 297–300, 307–310, 329, 355, 408

(56) References Cited

U.S. PATENT DOCUMENTS

| | | | | | |
|---|---|---|---|---|---|
| 1,249,500 | A | * | 12/1917 | Richter | 362/147 |
| 1,786,371 | A | * | 12/1930 | Van Dijck | 362/298 |
| 2,011,678 | A | * | 8/1935 | Downer | 362/300 |
| 2,107,027 | A | * | 2/1938 | Doane | 362/300 |
| 2,284,194 | A | * | 5/1942 | Gangbin | 362/151 |
| 2,456,166 | A | * | 12/1948 | Arenberg | 362/308 |
| 4,349,866 | A | * | 9/1982 | Molnar | 362/298 |
| 4,600,975 | A | * | 7/1986 | Roberts | 362/147 |
| 4,849,864 | A | * | 7/1989 | Forrest | 362/225 |
| 5,097,401 | A | * | 3/1992 | Eppler | 362/298 |
| 5,142,459 | A | | 8/1992 | Swarens et al. | 362/217 |
| 5,521,801 | A | | 5/1996 | Pesau et al. | 362/147 |
| 5,558,425 | A | * | 9/1996 | Pons et al. | 362/300 |
| 5,823,656 | A | | 10/1998 | Waldmann | 362/147 |

FOREIGN PATENT DOCUMENTS

| | | |
|---|---|---|
| DE | 33 18 264 A1 | 11/1984 |
| DE | 37 04 501 A1 | 9/1987 |
| DE | 36 33 976 A1 | 10/1987 |
| DE | 42 33 481 A1 | 4/1994 |
| DE | 195 07 333 A1 | 9/1996 |

OTHER PUBLICATIONS

W. Elenbaas et al., *Fluorescent Lighting*, edited by C. Zwikker, Philips Technical Library, 1952, pp. 152–154.

* cited by examiner

*Primary Examiner*—Alan Cariaso
(74) *Attorney, Agent, or Firm*—Young & Thompson

(57) ABSTRACT

A light fitting (10) for receiving a lighting device (12) located within a main body (11). The main body (11) includes a substantially reflective surface (13*a*) to direct light (17) from the lighting device (10) onto an area to be lighted. The main body (11) also includes a light directing element (18) to direct light (19) from the main body (11) across a ceiling (C) that, in use, is adjacent the light fitting (10).

8 Claims, 4 Drawing Sheets

LIGHT FITTINGS

BACKGROUND TO THE INVENTION

The present invention relates to improvements in light fittings.

As the use of personal computers with visual display units (VDUs) has become more common, it is now desirable for office lighting to be provided which minimises glare on the VDU screen. Glare can occur from overhead lighting which emits light at an angle greater than 50° or 60° (all angles described herein are with reference to the vertical unless stated otherwise).

Light rays at this angle or greater bounce off VDU glass into the eyes of the user and can make reading the screen difficult (dependent on the intensity of the light).

To overcome the problem of screen glare the obvious solution is to utilise light shades which restrict light to less than a 60° beam. This light cut-off angle has an unfortunate side-effect that the upper walls and ceiling of the office become oppressively dark and uninviting.

To overcome the oppressive darkness created by light shades, "up-lighting" has been used to direct light upward from the light fitting to illuminate the ceiling.

However, in order for this technique to be successful the ceiling height of the office has to be about 3 metres high otherwise the effect of the up-lighting becomes a hot spot and creates annoying reflective glare. One will appreciate that not all office ceilings will be 3 metres high.

If the fitting is located close to the ceiling, patchy light spots result. Alternatively, if fittings are located too low then head room and room aesthetics may be affected.

Furthermore, any horizontal elements located on top of known "up-lighting" fittings can become dirty very quickly and cause premature performance and hardware degradation.

Another method of providing ceiling lighting involves using strip lighting within an "encove" adjacent the ceiling. To some degree the strip lighting creates a lightened effect across the ceiling however often only the corners appear bright and the remainder of the ceiling is still dark.

Furthermore, the gaps between adjoining strip lights can cause dark or unevenly lit patches on the visible portion of the ceiling. To remedy this, it is common to overlap the strip lights so no "gaps" are visible in the light projected onto the ceiling. It will be appreciated that this method is complicated to design and time consuming to install. Cost can also be a factor.

SUMMARY OF THE INVENTION

An object of the present invention is to provide a light fitting for lighting of the ceiling that enables a uniform 'wash' of light for desirable aesthetic effect. Preferably the light fitting can be mounted close to a ceiling.

In a first broad aspect of the invention there is provided a light fitting for mounting adjacent to a ceiling adapted to receive a lighting device located within a housing, said housing being substantially sealed from the intrusion of dust, further including a substantially reflective surface to direct light in a desired direction across the ceiling and a diffuser mounted at a light emitting side of the housing, said diffuser being arranged at an angle close to vertical (wherein the ceiling is in a horizontal plane).

Preferably, the housing is adapted to receive elongate lighting devices, such as strip lights.

Preferably the invention, as described by the first broad aspect, may be utilised in a method of evenly lighting a ceiling, wherein a plurality of housings can be arranged end-to-end with diffuser edges substantially contacting.

DESCRIPTION OF THE PREFERRED EMBODIMENTS

Figure 1:
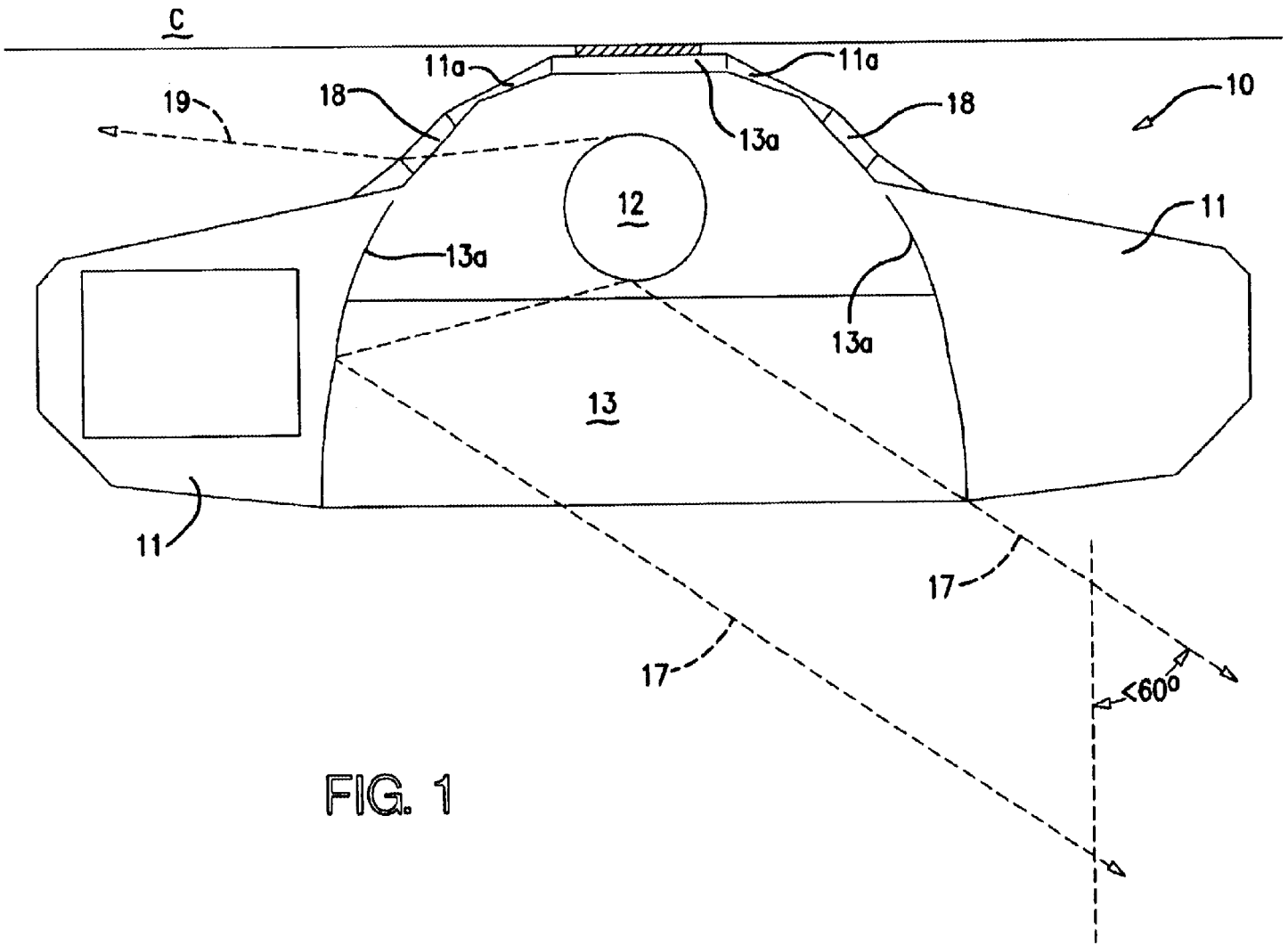
FIG. 1 is an end elevation view of a preferred embodiment of a light fitting according to the first broad aspect of the present invention.

FIG. 1 illustrates a light fitting 10 constructed from a main body 11 which houses a standard light source 12. The light source 12 it this preferred embodiment is a strip light, however other "bulb" lights may also utilise the present invention.

Light 12 is housed within a cavity 13 of main body 11 which includes a reflective curved surface 13*a*. Light 12 is positioned within the cavity 13 such that its light rays 17 may only exit the main body 11 at a maximum of 60° (as seen by the dotted detail lines 17). Controlling light angles in this way is well known.

The enclosure of light 12 within cavity 13 has the effect of restricting the light rays 17 so that they do not cause glare onto VDU screens as outlined in the preamble. Preferably, the substantial surface 13*a* of cavity 13 is reflective (including above the position of light 12) to direct light downwards as brightly as possible. It is also usual that a diffuser (not illustrated) be located at the opening of cavity 13.

The exception to the above reflective covering of surface 13*a* is the apertures la formed in an upper wall 11*a* of main body 11. In the embodiment illustrated by FIG. 1, apertures 18 are formed substantially at the same level with the light 12 such that horizontal light 19 may exit the main body 11 horizontally (or at least at a shallow angle with reference to a ceiling C).

It will be apparent from FIG. 1 that this light 19 will illuminate the ceiling C to which upper wall 11*a* is fixed. As the angle of light 19 hitting the ceiling C is gentle, a "wash" effect is achieved which preferably avoids any undesirable patches of light.

The embodiment illustrated by FIG. 1 utilises prisms within apertures 18 to direct and disperse light as is known to those skilled in the art.

The prism (18) has the effect of bending light 19 slightly upward toward ceiling C. Use of prisms is preferable but not essential to the invention as light 19 will still exit aperture 18 without the aid of a prism.

The light fitting 10 as embodied by FIG. 1 thus provides a construction which eliminates glare on VDU screens below (by virtue of the restricted light angle 17) yet allows a soft wash of ceiling light (by virtue of apertures/prisms 18 and light 19 passing therethrough). Light upon ceiling C creates more comfortable working environment. Furthermore, the light fitting is mounted substantially closer to the ceiling than was otherwise possible with existing fittings.

Figure 2:
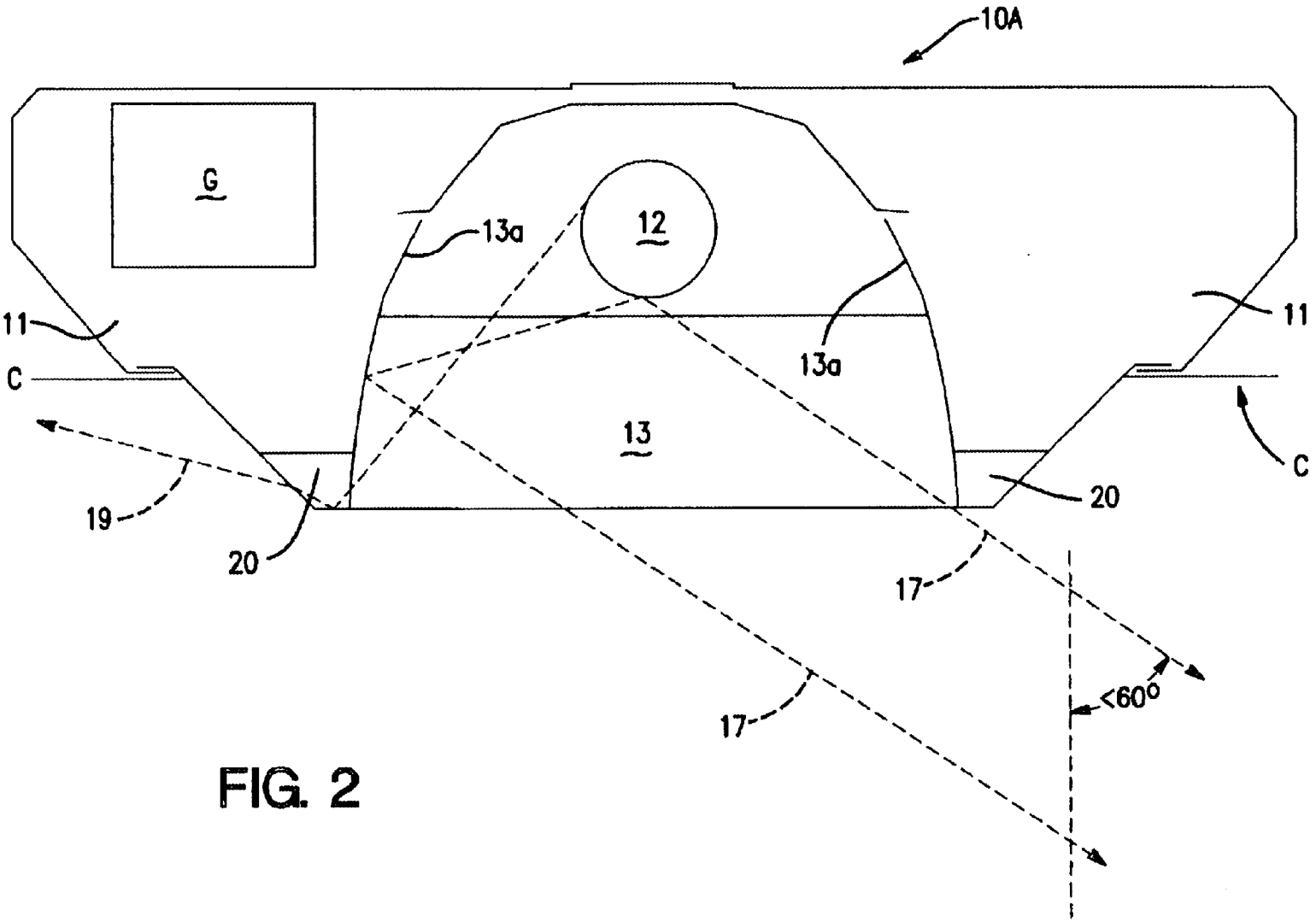
FIG. 2 is an end elevation view of a second embodiment of a light fitting according to the first broad aspect of the present invention.

FIG. 2 illustrates an alternative embodiment of a light fitting according to the invention. Where possible the same numerals are used to describe the components as shown by FIG. 1.

FIG. 2 illustrates a recessed light fitting 10A with a main body 11. Light fitting 10A is recessed into ceiling C to disguise the bulk of main body 11 (including control gear G).

The layout of cavity surface 13*a* in FIG. 2 is comparable to FIG. 1 in that the light 12 is located to restrict the majority of emitted light 17 to 60° or less.

Light fitting 10A includes prisms 20 at the open mouth of cavity 13 which manipulate light 19 and bend it back towards ceiling C. The end result is a light "wash" of ceiling C the same as the first embodiment illustrated by FIG. 1.

This second embodiment 10A generally is less obtrusive into a room but achieves the same effect of minimising VDU screen glare while sufficiently illuminating the ceiling for desirable aesthetics.

Figure 3:
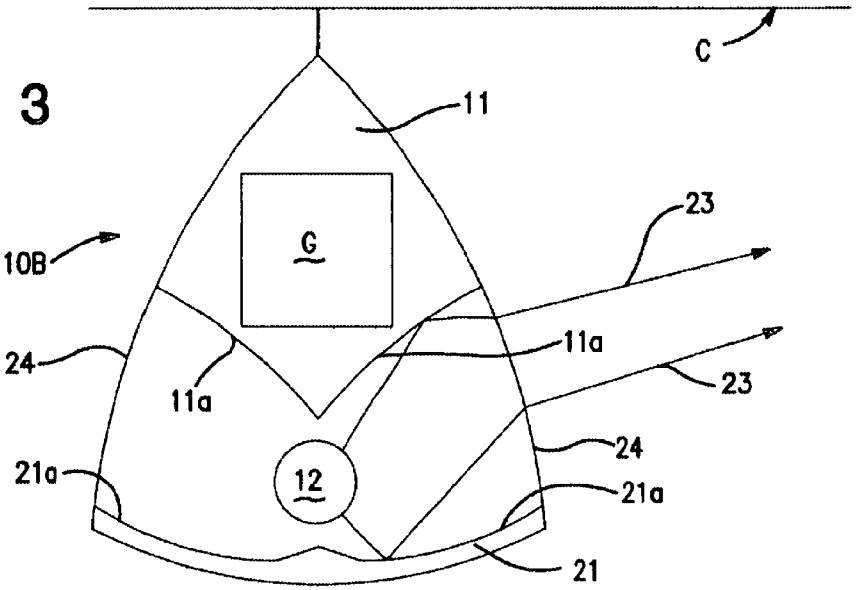
FIG. 3 is an end elevation view of a third embodiment of a light fitting according to a first broad aspect of the present invention.
Figure 4:
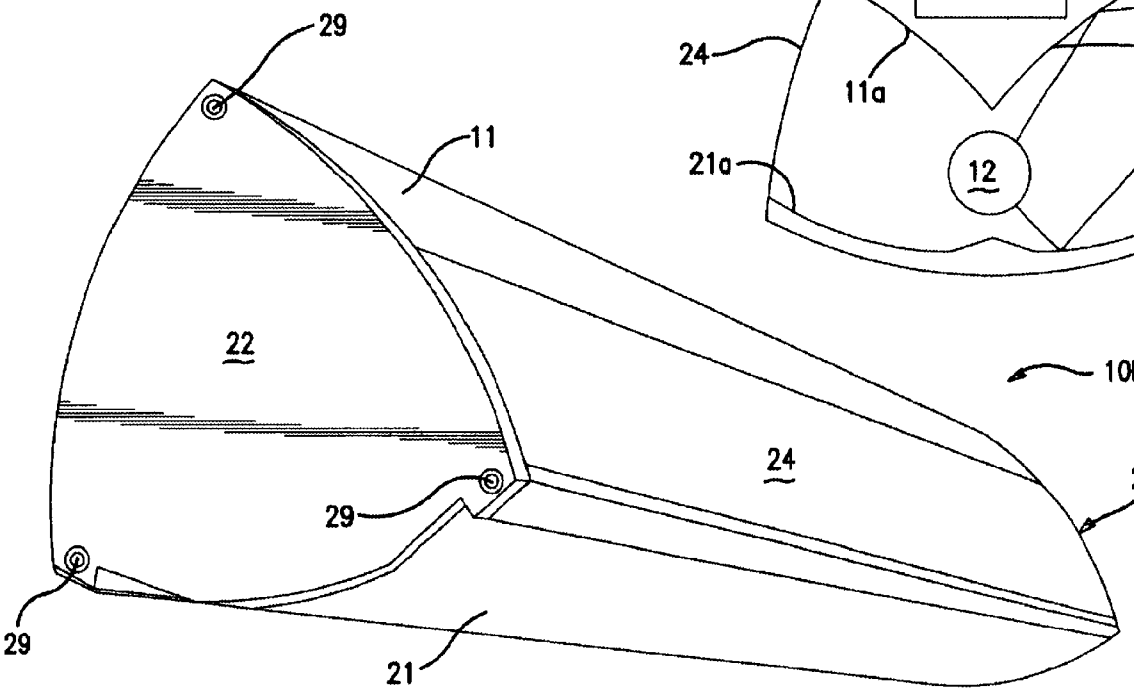
FIG. 4 is a perspective view of the light fitting illustrated in FIG. 3.

A further embodiment is illustrated by FIGS. 3 and 4.

The light fitting ion is intended solely for "up-lighting" where a ceiling C may be illuminated for visual effect. There is no downward travel of the light rays to illuminate the remainder of the room.

Light fitting 10B is principally comprised of a main body 11, housing control gear G, a light source 12 and a lower curved reflector panel 21 (in addition to reflective upper wall 11*a)*.

As seen in FIG. 4, the curved reflector 21 is connected to main body 11 via an end piece 22 fixed by suitable fastenings 29. End pieces 22 are preferably not translucent or transparent such that light 23 is only emitted through side openings 24 in a controlled manner.

Curved reflective surfaces 11*a*and 21*a* (located facing one another) on the main body 11 and panel 21 respectively direct light 23 substantially horizontally or toward ceiling C. Each surface 11*a* and 21*a* is optically designed to direct light away from the interior of a room (thereby preventing glare) and to maximise light output from the light source 12.

The gentle angle of light 23 upon ceiling C creates a "wash" effect of light comparable to the previous embodiments shown by FIGS. 1 and 2.

Side openings 24 may include a luminous cover to prevent dust particles from entering the fitting 10B. The embodiment illustrated by FIGS. 3 and 4 include a cover over openings 24 which utilise prisms for optimum light distribution, glare prevention and generally more control over the direction of light exiting fitting 10B.

The third embodiment 10B provides an improved construction which overcomes problems associated with previous "up-lighting" designs. No light patches or hot-spots are created by this present invention.

Figure 5:
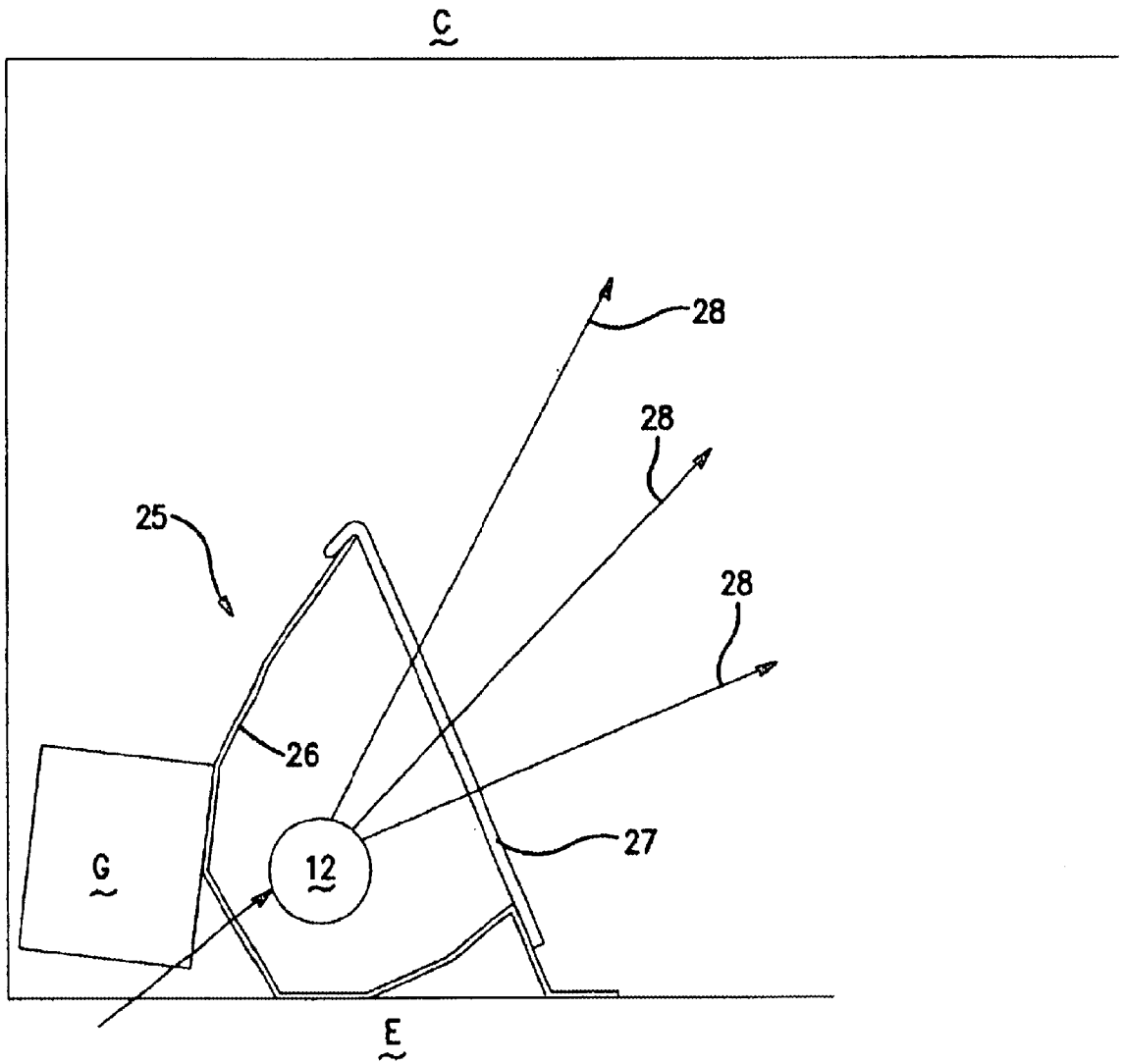
FIG. 5 is a side elevation view of a light fitting according to the second broad aspect of the present invention.

FIG. 5 addresses a method for installing lighting into an "encove" adjacent the ceiling.

A light fitting 25 includes a light source 12, a reflector 26, a diffuser 27 and control gear G.

The diffuser 27 as illustrated is at an angle close to the vertical such that dust collection as far as possible is minimised. As can be seen clearly by arrows 28, light rays are directed across the ceiling C evenly.

Diffuser 27 also ensures that adjacent light fittings 25 located end-to-end create an even light wash such that no "gaps" are noticeable when viewed from within the room. Conventional naked strip lighting tends to cause harsh black spots or "gaps" between lighted areas.

It will be appreciated that the light fitting 25 itself will not be visible from the ground. The only visible effect will be an evenly lit ceiling.

Overall, the embodiments of the present invention described herein include the common feature of light directed substantially horizontally to "wash" a surface in light. The constructions described represent an improvement over previous designs or at least provide an alternative lighting option for the public.

What is claimed is:

1. A light fitting comprising:

a main body for mounting adjacent to a ceiling, a lighting device within the main body, the main body having two apertures through which light from the lighting device emits, a substantially reflective surface optically arranged to only direct light from the lighting device through said two apertures and across the ceiling, the main body being substantially sealed from the intrusion of dust and including diffusers mounted with the main body to cover said two apertures, said diffusers being arranged at an angle close to vertical, wherein the reflective surface includes reflective panels located substantially above and below the lighting device to direct light outwards towards and across the adjacent ceiling.

2. The light fitting of claim 1, wherein said apertures are provided in an upper wall of the main body.

3. The light fitting of claim 1, wherein each of said apertures includes at least one prism.

4. The light fitting of claim 1, wherein the main body is elongate to receive a strip lighting device.

5. The light fitting of claim 1, wherein the lighting device is a bulb.

6. The light fitting of claim 1, wherein the reflective surface is curved.

7. The light fitting of claim 1, wherein the panels are curved.

8. The light fitting of claim 1, wherein each of said diffusers is provided between said reflective panels at a respective one of said apertures.

* * * * *